US005896714A

United States Patent [19]

Cymbala et al.

[11] Patent Number: 5,896,714

[45] Date of Patent: Apr. 27, 1999

[54] INSULATING CONCRETE FORM SYSTEM

[76] Inventors: Patrick M. Cymbala, 329 Canyon Close, Canmore, Alberta, Canada, TIW IH4; Andrew W. Cymbala, P.O. Box 814, Gibbons, Alberta, Canada, T0A 0N0; Gregory J. Doren, 335 Lady MacDonald Crescent, Canmore, Alberta, Canada, T1W 1H6; Allan M. R. MacRae, 38 Edgeview Road N.W., Calgary, Alberta, Canada, T3A 4T8

[21] Appl. No.: 08/814,876

[22] Filed: Mar. 11, 1997

[51] Int. Cl.[6] ..... E04B 2/00

[52] U.S. Cl. ..... 52/426; 52/427; 52/428; 52/568

[58] Field of Search ..... 52/426, 427, 428, 52/565, 568, 712, 105, 309.11, 309.12, 592.1, 592.6, 604, 605, 607, 657, 693

[56] References Cited

U.S. PATENT DOCUMENTS

| | | | |
|---|---|---|---|
| 4,229,920 | 10/1980 | Lount . | |
| 4,698,947 | 10/1987 | McKay . | |
| 4,706,429 | 11/1987 | Young . | |
| 4,730,422 | 3/1988 | Young . | |
| 4,731,968 | 3/1988 | Obino . | |
| 4,866,891 | 9/1989 | Young . | |
| 4,884,382 | 12/1989 | Horobin . | |
| 5,311,718 | 5/1994 | Trousilek | 52/580 |
| 5,390,459 | 2/1995 | Mensen . | |
| 5,709,060 | 1/1998 | Vaughan et al. | 52/426 |

FOREIGN PATENT DOCUMENTS

| | | |
|---|---|---|
| 56 546 | 10/1968 | Luxembourg . |
| WO 95/23899 | 9/1995 | WIPO . |

*Primary Examiner*—Creighton Smith
*Attorney, Agent, or Firm*—Sheridan Ross, P.C.

[57] ABSTRACT

A concrete form foam block, of an Insulating Concrete Form System, comprises a pair of opposed and parallel foam panels spaced using a plurality of plastic ties. Each tie comprises full panel height flanges which engage the panels and a web portion extending therebetween. The web comprises a plurality of horizontal members, preferably four or more, which are distributed substantially along the full height of the flanges. The web includes a pair of full height anti-flash members for preventing the escape of flash during formation of mould-in panels. The top edges and bottom edges of each panel are formed with longitudinal tongues and grooves which interlock with adjacent blocks. Preferably additional transverse top tongues and complementary bottom grooves are located at each tie, forcing the alignment of vertically adjacent block's flanges. The combination of full height and aligned flanges results in a substantially continuous flange for the attachment of finishing materials. Preferably, indicia are provided, seen from the outside of the panel, for locating the position of the flanges. The same tie can be used in both a moulded-in or a slide-in configuration. Slide-in panels are formed with "T"-shaped slots amenable to accept the flanges of the ties.

19 Claims, 6 Drawing Sheets

INSULATING CONCRETE FORM SYSTEM

FIELD OF THE INVENTION

The present invention relates to concrete construction utilizing foam block forms, more specifically to improvements to the foam panels, panel spacing ties and the interaction of the ties with the foam panels.

BACKGROUND OF THE INVENTION

Insulating Concrete Form Systems ("ICFS") are known which act as a form to contain the fluid concrete while it solidifies, and also provide insulation for the finished structure. ICFS utilise a plurality of individual units or blocks, assembled in an interlocking arrangement, to create the forms for the concrete walls Each block comprises a pair of foamed plastic panels, which are held together with a plurality of ties.

The ties are truss-like and comprise flange portions which reside within the foam panels and an intermediate web portion connecting the flange portions, thus securing and holding the panel portions. One such example is disclosed in U.S. Pat. No. 4,229,920 to Lount, issued Oct. 28, 1980 who teaches use of a block having a multi-component tie.

More contemporary ICFS designs have implemented ties having integral flanges and web portions. Examples of this construction include U.S. Pat. No. 5,390,459 to Mensen, U.S. Pat. No. 4,884,382 to Horobin and U.S. Pat. No. 4,731,968 to Obino.

Horobin teaches slide-in ties which have complementary flanges and "T" slots formed in the panels. Each slot extends from the top of the panel to a point just lower than the mid-point. Accordingly, both the tie and the flange portions of the tie are substantially less in height than the panel. The flange itself has an "H" profile in plan; the outer portion for engaging the panel's "T"-slot, and the inner portion for stabilizing the inner face of the panel. The tie's web comprises three horizontal tension members, joined together at the flanges.

Obino provides a tie similar to Horobin, but the flanges are moulded into the foam of the panel. Both the web and flanges are substantially shorter than the panels. The web structure is continuous; lacking any holes.

In Mensen, the tie is moulded into the panel with the flange located flush with the outside of the panel. The flange extends substantially the full height of the panel. In side view, the tie resembles an "H", the horizontal dash representing the web portion being much narrower that the flanges. Diagonal gussets extend from the web's midpoint to points adjacent the distal ends of each flange.

These above designs result in non-optimal distribution of the hydrostatic stress of the fluid concrete across the narrow central web portion of the tie and in the upper and lower portions of the foam panels. In Horobin and Obino, the foam portion is completely unsupported by the tie at the panel's upper and lower ends. In Mensen, the tips of the flanges are inadequately supported by the gussets. The result is excessive deformation of the top and bottom portions of the foam panels when filled with concrete. This is especially apparent when high vertical concrete lifts (a full; 8' high wall) are poured in a single stage.

Mensen, Horobin and Obino permit attachment of interior and exterior surface finishing materials such as drywall or siding to the vertically-oriented flange portions of the ties. Of these three designs, only Mensen provides a flange which extends substantially the full height of the panels and is visible from outside the block for ease of attaching fastening devices.

Conventional systems permit vertical misalignment such that the flanges of adjacent blocks are not always aligned vertically. This poses difficulties for installers who need to accurately locate the flanges when attaching finishing materials Within the typical dimensions of building construction there is frequently the need for a half-height concrete form block to be used, for example, below and above window openings. Although some ICFS designs provide a custom block having a less-than-standard height, none of the existing designs permits a block to cut horizontally in half to create a "half-height" block which continues to provide independently structurally sound characteristics.

In summary, the blocks of conventional systems, as described above, have the following features in common:

- a pair of substantially rectangular foamed plastic panels;
- two or more ties which extend across the space between panels for securing the panels in opposing, parallel, and spaced orientation, the spacing forming a cavity therebetween for containing the fluid concrete while it solidifies;
- the web portions of the ties being substantially less in height than the panels; and
- means associated with the edges of the panels for engaging cooperating means on adjacent blocks in order to assemble the complete wall form system.

Disadvantages associated with the above systems include:

- inadequate support of hydrostatic pressures;
- deficient flange configuration, being either,
  - that they are too short to provide a convenient support upon which to mechanically fasten finishing materials as in Horobin and Obino, or
  - that they cause interruption of the integrity of the outer face of the panel, compromising adhesion of surface mount materials like stucco, as is the case in Mensen; and
- permitting misalignment of flanges between vertically adjacent blocks, further complicating the mechanical fastening of the finishing materials.

Despite attempts to solve various shortcomings of the conventional blocks, the applicant is not aware of a system which provides sufficient strength to competently support the hydrostatic head of a full-height wall of fresh concrete, and enables convenient attaching of finishing materials.

SUMMARY OF THE INVENTION

The apparatus of the present invention avoids the structural weaknesses associated with the ties of the prior art and increases the versatility of the ties and blocks.

Prior art ties are designed, in part, to accommodate poor concrete placement practice. Practised for many years, one characteristic of low quality concrete mixing and placement practice has been to pour concrete from a minimum number of locations and rely on lateral flow to distribute the concrete along the length of the forms. To facilitate this lateral flow, the concrete was often mixed with an excessively high water content, resulting in poor concrete quality. To further facilitate lateral concrete flow, it has also been traditional practise to minimise the height of the ties inside the forms so as to provide the least obstruction to flow along the form. As described above, this tie design results in a weaker ICFS block.

In contradistinction, It is known that concrete should be mixed with the minimum amount of water necessary for proper chemical hydration of the cement. This "low-slump" concrete, which does not readily flow, provides significantly higher ultimate strength and reduces shrinkage and cracking of foundations. Further, modern placement equipment enables vertical placement of concrete into the forms from many closely spaced locations, eliminating the reliance on lateral flow.

Accordingly, and contrary to the conventional wisdom, in a first embodiment of the invention, a novel ICFS block is provided having a tie which incorporates flanges which extend substantially the full height of the panels, and have a plurality of horizontal tensile web members which are distributed substantially along the full height of the flanges. The members uniformly resist horizontal forces generated by the fluid concrete acting on the foam panels.

Preferably at least two horizontal members are located above the web's midpoint and two below so as to produce two independently structurally sound half-height blocks if cut laterally in half. Sufficient open area is provided through the tie to permit lateral concrete flow to occur across the ties so as to form an integral concrete mass.

Complementary tongue and groove features are formed into the top, bottom and end edges of the panels to enable interlocking of adjacent blocks.

In a first broad aspect of the invention then, a concrete form block is provided comprising:

a pair of rectangular foam plastic panels having inner and outer faces, top and bottom and end edges;

at least two ties spaced longitudinally and parallel from each other, each of which extend perpendicularly between the inner faces of the panels so as to space the panels in opposing and parallel orientation, each tie having two opposed flange portions and a web portion extending therebetween, each flange portion forming a vertical stud which extends substantially the height of the panels and is moulded within each panel, the web portion comprising a plurality of horizontally extending members distributed substantially along the full height of the flanges, the web having a majority of its cross-sectional area comprising open space; and interlocking means along the edges of the panels so that the block interlocks with other blocks when placed adjacent one another.

In a second aspect of the invention, the top edges of each panel are formed with additional transverse tongues at the location of each tie. Complementary transverse grooves are formed in the bottom edges. The transverse tongues and grooves cooperate to force vertically adjacent blocks to always interlock such that the flanges of their respective ties are aligned. The combination of the full height aligned flanges result in a substantially continuous flange for the attachment of finishing materials. Preferably, indicia are provided, seen from the outside of the panel, for locating the position of the flanges.

The flanges of the tie reside wholly within the body of the panel. The plurality of the tie's horizontal members extend from the flanges, which are located within the panel, and pass through the block's cavity. For a moulded-in embodiment, this arrangement imposes a difficult task upon the moulding process so as to prevent the escape ("flash") of panel-forming foam from between the horizontal members and into the cavity.

Accordingly, in a third aspect of the invention, it is preferable to include an anti-flash member for forming a continuous barrier between all the members at the interface of the panel's inner face and the block's cavity. The anti-flash member comprises a light member which extends substantially the entire height of the tie, offset from the flange sufficiently so as to correspond with the inner face of the panel. The member is non-structural and merely strong enough to restrain flash.

The tie can be used, without modification, in both a moulded-in or a slide-in tie configuration. Moulded-in tie blocks provide the advantage of avoiding work-site assembly, but are more expensive to ship than are the collapsible, more compact slide-in tie blocks. For a slide-in embodiment, the same tie is utilized as described above, incorporating the full panel-height flanges, full panel height web with two or more horizontal members distributed both above and below the web's mid-point. The panels are formed with "T"-shaped slots amenable to accept the flanges of the ties. As above, complementary transverse tongue and grooves are formed in the respective top and bottom edges of the panels to force the flanges in vertically adjacent blocks to always align.

DETAILED DESCRIPTION OF THE PREFERRED EMBODIMENT

Figure 1:
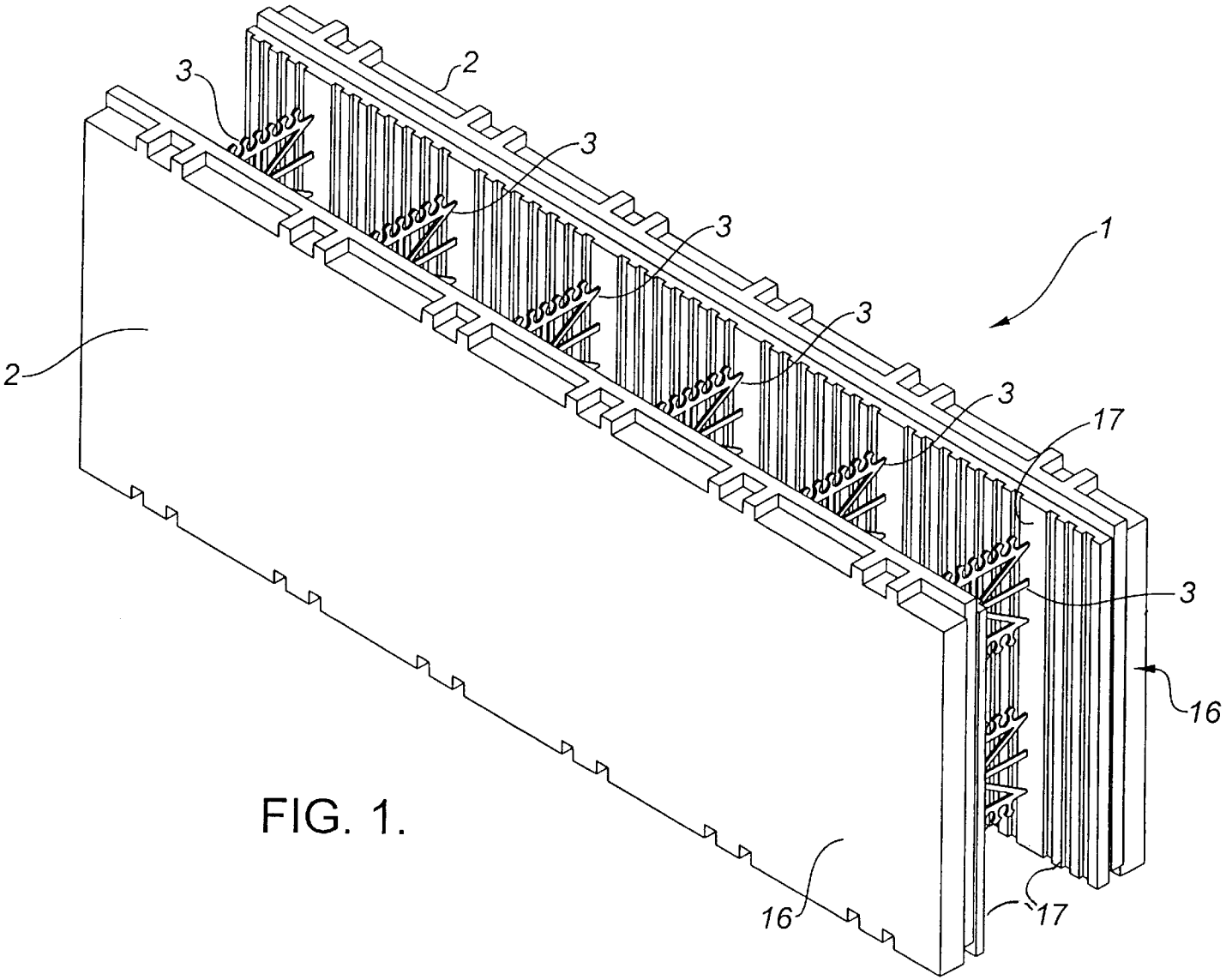
FIG. 1 is a perspective view of a single block which incorporates features of the first embodiment of the present invention, including a mould-in tie and inter-block interlocking tongue and grooves.
Figure 7:
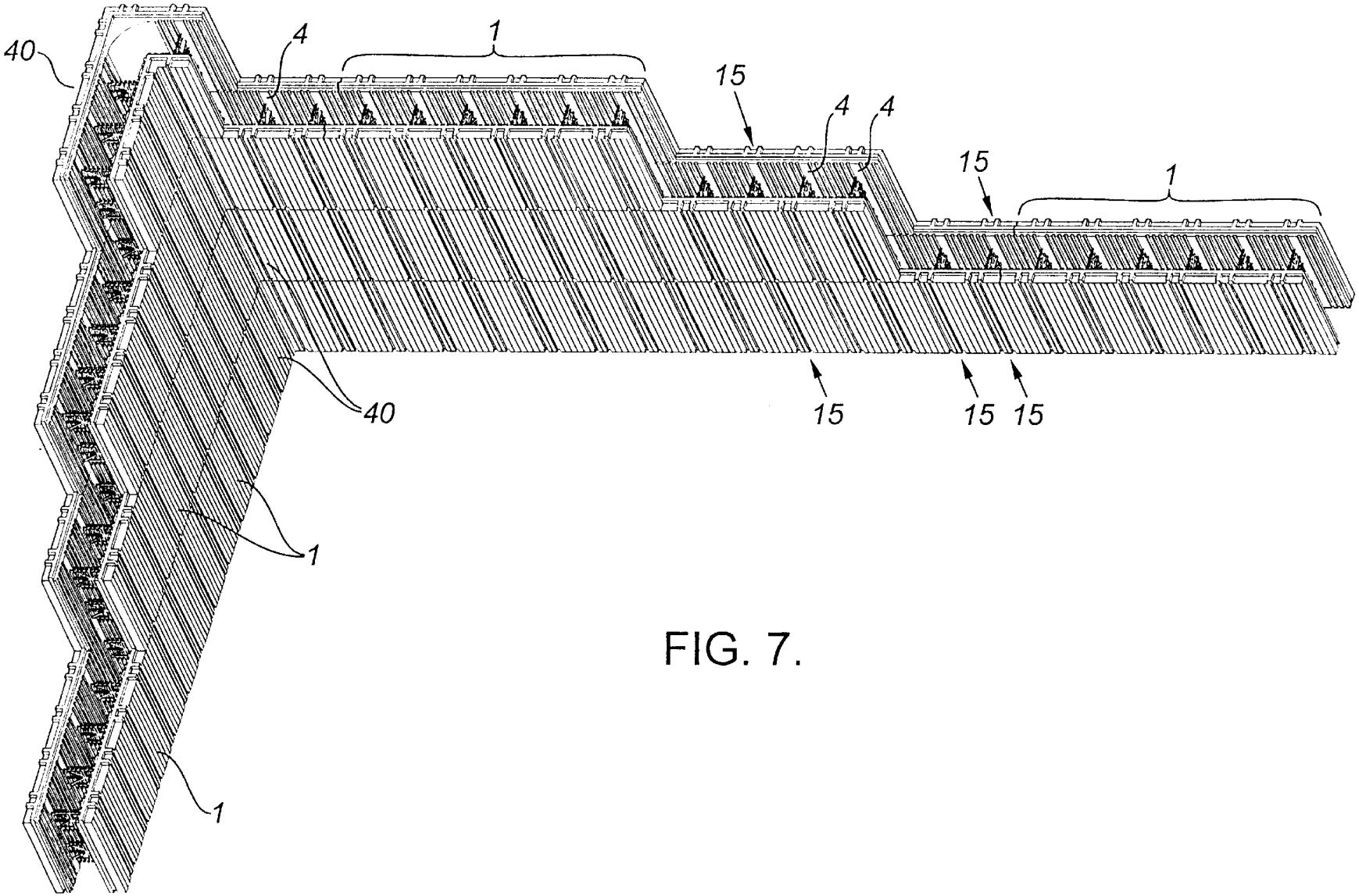
FIG. 7 is a perspective view of a plurality of blocks, of either embodiment, assembled for illustration of the vertical alignment of flanges.

Having reference to FIG. 1, one block 1 of an Insulating Concrete Form System ("ICFS") is shown. A plurality of blocks 1 are laid adjacent each other, longitudinally end-to-end and vertically row-by-row (FIG. 7). For strength, each successive row has the ends of each block offset from the ends of the blocks in the adjacent rows.

In conventional and the novel systems, each block 1 comprises two rectangular foam panels 2 typically formed of expanded polystyrene. Each panel 2 has an outer face 16 and an inner face 17. Two or more ties 3 (six shown) extend transversely between the panel's inner faces 17 to locate the panels 2 in parallel opposed and spaced relation to each other. The ties 3 are spaced longitudinally and parallel to each other along the panels 2.

Figure 2A:
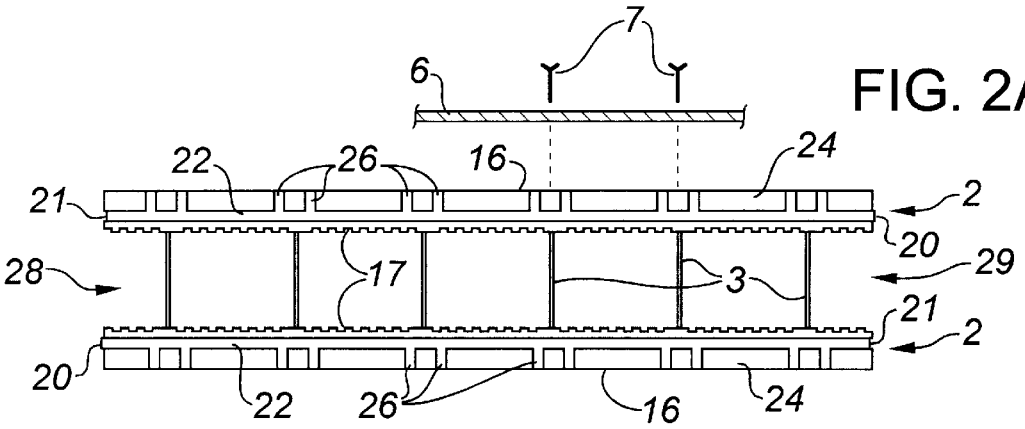
FIGS. 2*a*, 2*b*, 2*c* and 2*d* are top, front, bottom and end orthographic views respectively of the block of FIG. 1.
Figure 2B:
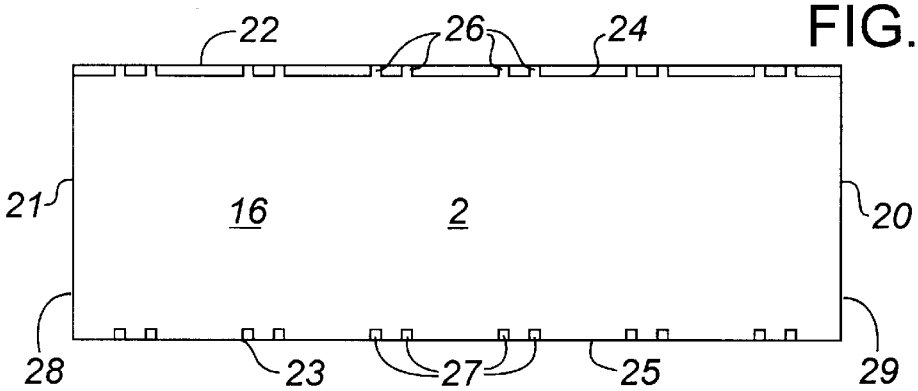
Figure 2C:
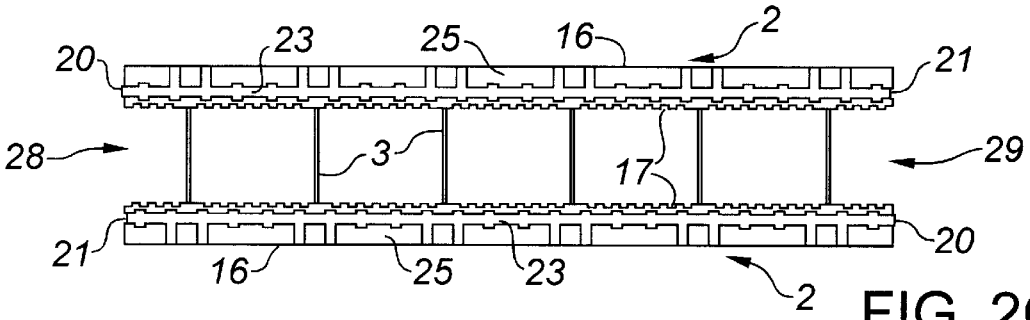
Figure 2D:
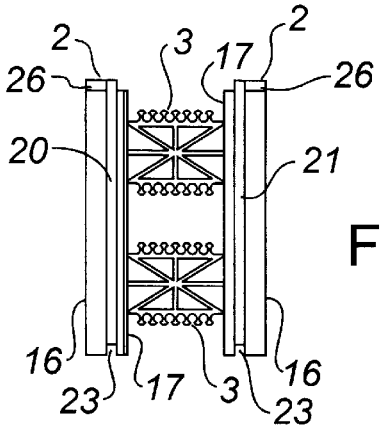
Figure 3:
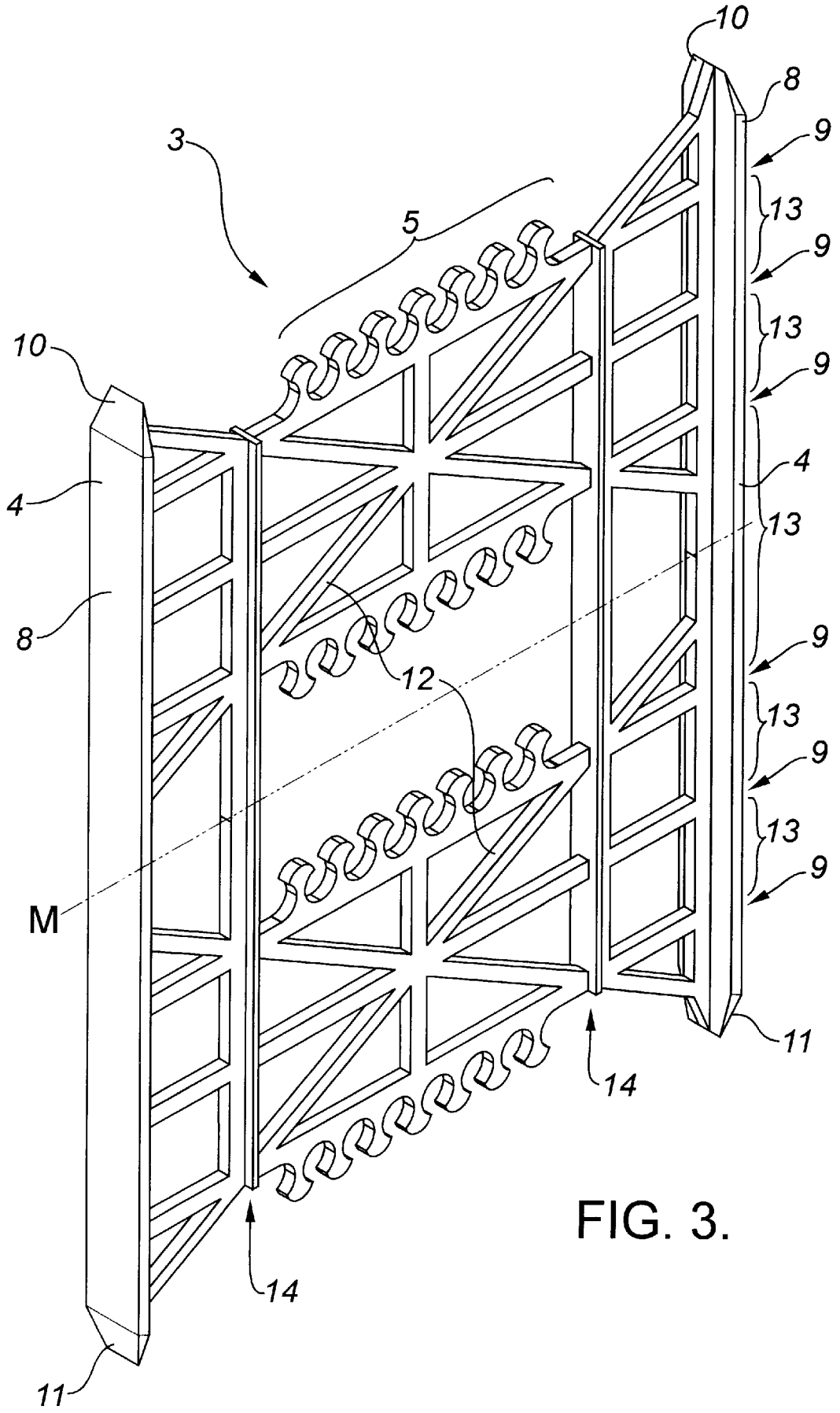
FIG. 3 is a perspective view of a tie of the block of FIG. 1.

Having reference to FIGS. 2*a* through 3, each tie 3 comprises two laterally opposed flange portions 4 and a web portion 5 extending therebetween. Typically a tie is a unitary plastic structure of high density polyethylene or polypropylene.

Each flange 4 engages one of the opposed panels 2 and prevents lateral movement relative to the opposed panel 2.

Flanges 4 also serve as a structure to which finishing materials may be secured. Shown in exploded view in FIG.

2*a*, sheeting material 6 is attached to the flanges 4 with mechanical fasteners 7.

Thus far, the description of the block of a ICFS is also descriptive of the prior art systems.

In a first embodiment of the present invention, a novel ICF System is provided in which novel ties 3 and complementary panels 2 are formed in a moulded-in configuration. The same tie 3 (FIG. 3) is also amenable to a slide-in application as disclosed in a further embodiment discussed later.

Tie 3 has a web portion 5 and opposing flange portions 4. The flange 4 forms a "T"-shape in section. The outermost portion the "T" 8 lies parallel to the plane of the panels 2.

The height of each flange 4 is substantially equal to the full height of the panels 2. As shown in FIG. 7, when the ties 3 are aligned with the ties 3 of blocks 1 in adjacent rows, the full-height flanges 4 form a nearly continuous structure 15 upon which to attach and support finishing materials, such as drywall or siding.

The flanges 4 are structurally maintained in a spaced apart and parallel relation by the tie's web 5. The web 5 comprises a plurality of members 9 extending horizontally between flanges 4. The horizontal members 9 are distributed vertically between the flange's top 10 and bottom 11. At least two members 9 (3 are shown) are located above the mid-point M of the web, and at least two members 9 (3 shown) below. Should the ICFS block be cut laterally in half, at least two horizontal members 9 remain above the cut and at least two members 9 will remain below the cut, thereby providing independent and structurally sound half-blocks (not shown).

Diagonal members 12 in the web provide torsional stiffness.

The overall cross-section of the horizontal members 9 is sized to withstand hydrostatic pressure of fluid concrete pressing laterally outwardly on the inner faces 17 of the panels 2 without causing excessive panel deflection. Using six plastic ties 3, spaced along a 1⅓' high×4' long panel, and wherein each tie 3 has six horizontal members 9 which are about 0.25" high×0.20" in section, the block's panels 2 can withstand a pressure of a height of eight feet of concrete poured at once.

The plurality of members 9 extending between flanges poses a challenge during the moulding process. Along a plane where the inner face 17 of the panel 2 forms, the tie 3 comprises an alternating pattern of members 9 and space 13. For properly forming foam panels, the moulding equipment must successfully restrain the flow of foam ("flash") about each member 9 to limit its escape.

Accordingly, thin flatbar-like anti-flash members 14 extend the height of the web 5 and with their cross-sectional plane lying parallel to the flanges 4. The anti-flash members 14 bridge the open space 13 between members 9 so as to form a continuous barrier. The anti-flash members 14 are non-structural and merely block foam from escaping during the moulding process. The anti-flash members are spaced sufficiently inwardly from each of the flanges so as to cooperate, with moulding equipment and align with the inner face 17 of the panel 2. Typically, for a panel thickness of 2½", the flange 4 is inset about ⅜" from the outer face of the foam panel, and the anti-flash 14 members are spaced about 2⅛" from the flanges.

Once moulded-in, the ties 3 and panels 2 form a unitary block 1 of an ICFS.

Tongue 20 and grooves 21 are provided at the block's two ends 28,29 to interlock panels 2 together and prevent transverse misalignment. A one end 28 of the block 1, the two ends of the panels 2 have opposing interlocking means 20,21; in other words, the end of one panel forms a tongue 20 and the end of the other forms a groove 21. In this way, full blocks 1 are not restricted to one mode of abutment with adjacent blocks.

Longitudinally extending tongues 22 protrude upwardly from the top edge 24 of both panels 2. The tongues 22 avoid collecting moisture and ice prior to assembly. Corresponding longitudinal grooves 23 are formed in the bottom edges 25 of the panels for interlocking with the top edge tongues 22 of a lower row of blocks 1.

At each longitudinal location of a tie 3, one or more short tongues 26 extend transversely from the top tongue 22. These short tongues 26 correspond with short transverse grooves 27 in the block's bottom edge 25. The short tongue 26 and grooves 27 cooperate to longitudinally locate the blocks of one row so that their ties 3 must align vertically with the ties 3 in the adjacent upper and lower rows.

Figure 4:
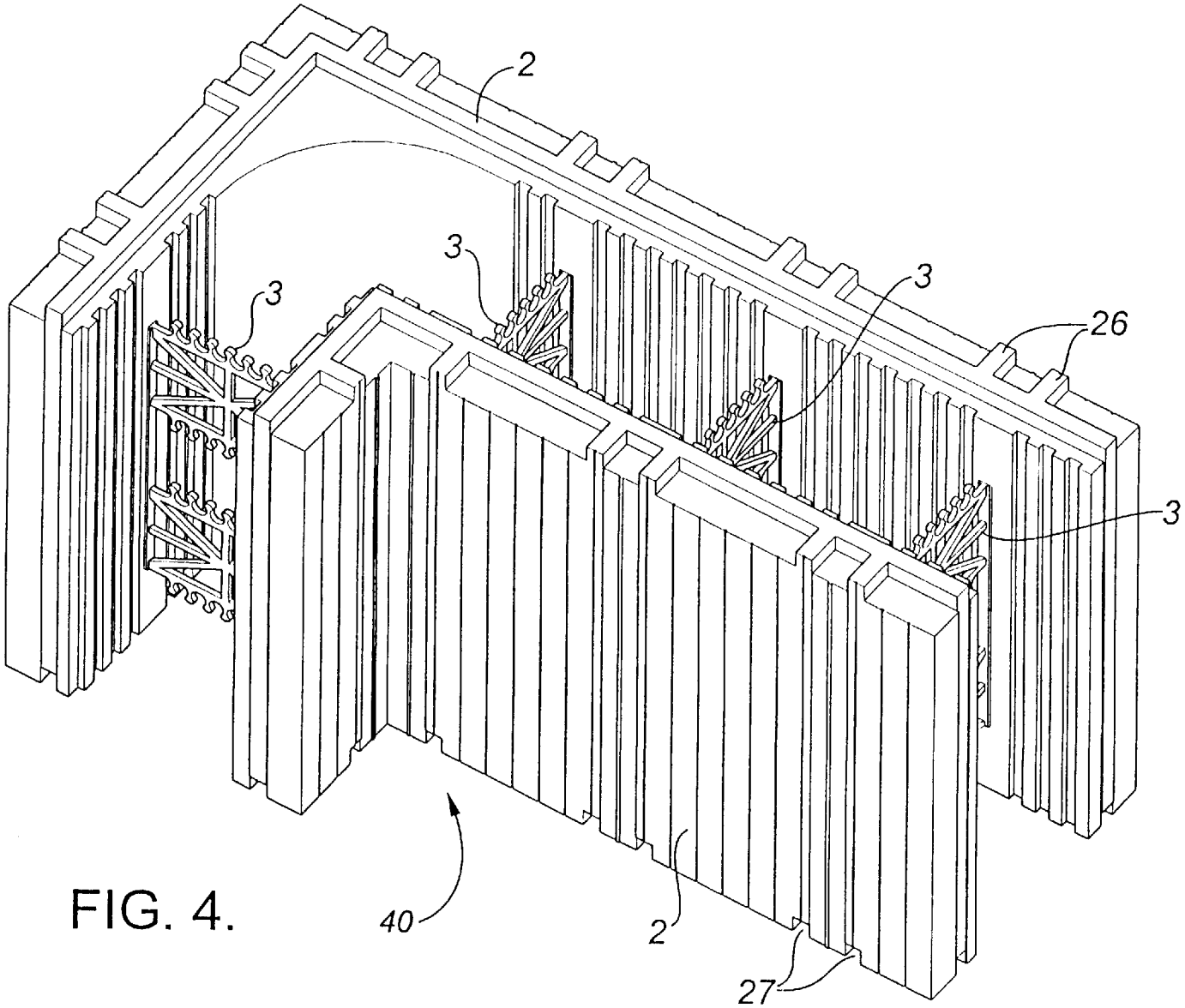
FIG. 4 is a perspective view of a corner block also incorporating moulded-in ties.

The short tongue and grooves 26,27 extend to the outer face 16 of each panel 2 and thus visibly indicate the location of each tie 3 (FIG. 1). The tongue and grooves 26,27 are arranged as corresponding pairs. Preferably, two tongue 26,26 and grooves 27,27 are placed in closely-spaced arrangement. As shown in FIGS. 2*a* and 4, the two tongues and grooves of a corresponding pair 26,27 are approximately arranged or straddle the dimensional periphery of the tie 3.

Alternatively, indicia lines or embossing is applied to the panel's outer face 16 to visibly indicate the location of the tie 3. As shown on FIGS. 4 and 7, indicia lines delineate the continuous structure 15 on vertically adjacent blocks 1. Further, the indicia can delineate the dimensional extent of the flange 4. Best shown in FIG. 4, the indicia is formed using an embossing or bas relief formed into the outer face 16 of the panel 2.

As shown in FIG. 4, the invention is equally well applied to a corner block 28.

Moulded-in tie blocks provide the advantage of avoiding work-site assembly. Unfortunately, such blocks are more expensive to fabricate and occupy more space and are therefore more costly to ship to remote construction sites.

Figures 5, 6:
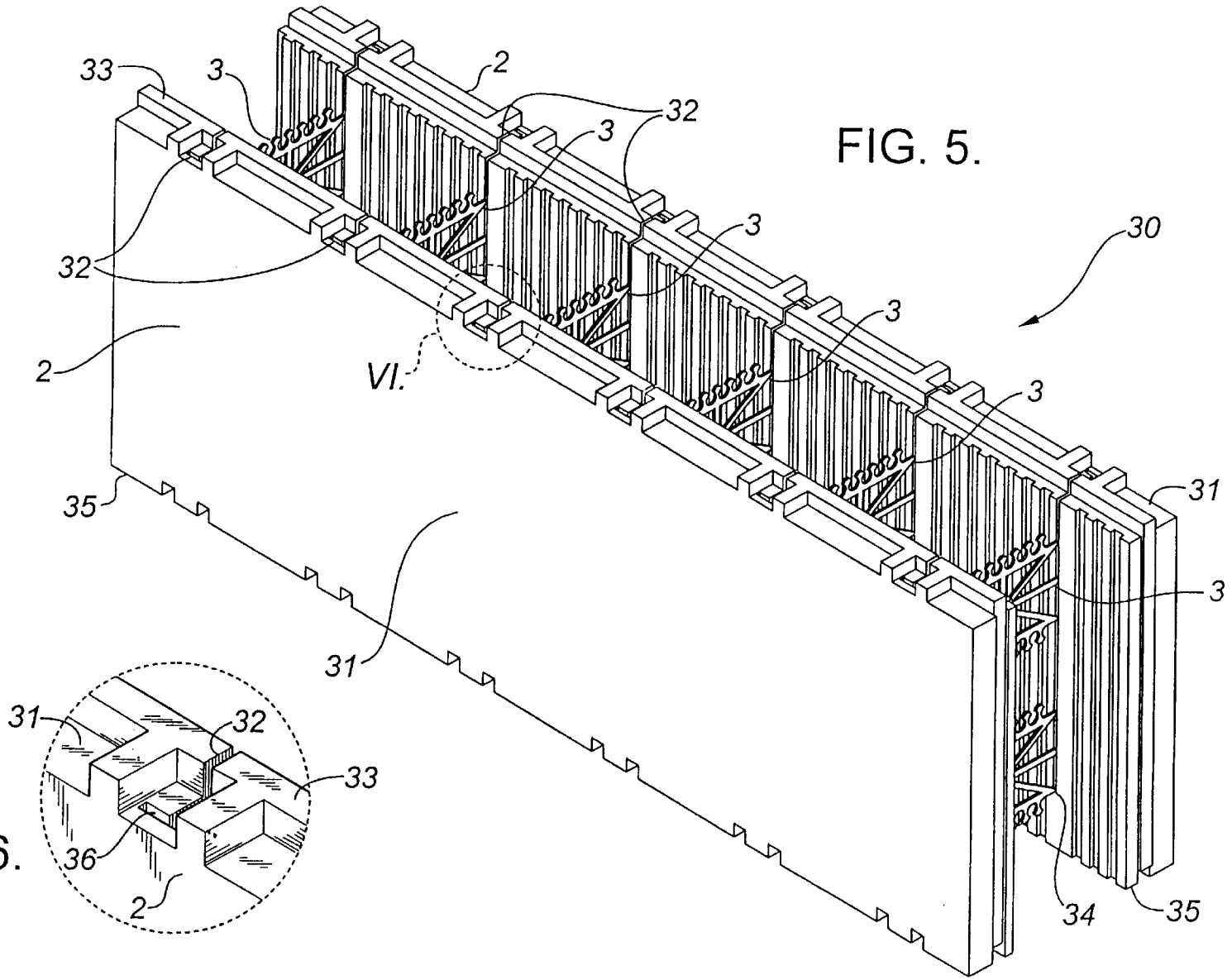
FIG. 5 is a perspective view of a single block which incorporates features of an embodiment of the present invention which uses slide-in ties.
FIG. 6 is a partial perspective view taken along lines VI—VI of the block of FIG. 5, illustrating a "T"-slot for a slide-in tie.

Accordingly, in a second embodiment and having reference to FIG. 5, it is desirable to provide block 30 which uses panels 31 and ties 3 which can be unassembled to form a more compact shipping unit.

Panels 31 are moulded without ties 3. A plurality of "T"-type slots 32 are formed in the panels 31. One "T" slot 32 is provided for each tie 3. The ties 3 are identical with those described for the first embodiment. Each slot 32 extends from the top edge 33 of the panel 31 to a point 34 adjacent the bottom edge 35 of the panel so as to accommodate the height of the tie's web 5.

Referring to FIG. 6, the outermost portion 36 of each "T" slot 32 is aligned longitudinally with the panel 31. The stem 37 of the "T" extends to the inner face of the panel 31.

The outermost portion 8 of the tie's flanges 4 (FIG. 3) slide into each "T" slot. The depth of the "T" slot 32 in the body of the panel 31 is coordinated with the tie's flange 4 and anti-flash member 14 so that the anti-flash members 14 do not substantially interfere with the panel 31 itself.

The use of a single tie 3 is preferable for both moulded-in and the modular slide-in tie embodiments. The single tie design is cost effective due to both the economies of scale in manufacturing a dual-purpose tie and due to reduced inventory costs.

The advantages achieved by the novel tie and panel system include:

the substantially full height web permits use of a plurality of horizontal web members distributed over the height of the flanges for strengthening the flanges against hydrostatic pressures;

full height flanges provide ample area for the attachment of finishing materials;

the forced alignment of flanges across successive rows of blocks ensures ease locating the flanges and installing finishing materials;

provision of two or more horizontal members above and two or more below the tie mid-point permits a block to be cut in half for increased versatility in assembly; and the same tie can be used in both a moulded-in and a slide-in application.

The embodiment of the invention in which an exclusive property or privilege is claimed are defined as follows:

1. In an insulating concrete form system, a concrete form block which is stackable side-by-side and vertically above and below with others of the concrete form block comprising a pair of rectangular foam plastic panels having inner and outer faces, top edges, bottom edges and longitudinal end edges;

at least two ties spaced longitudinally and parallel from each other, each of which extend perpendicularly between the inner faces of the panels so as to space the panels in opposing and parallel orientation, each tie having two opposed flange portions and a web portion extending therebetween, each flange portion forming a vertical stud which extends substantially the height of the panels and lies between the inner and outer faces of the panel;

first interlocking means along the top, bottom and longitudinal end edges of the panels so that the block interlocks with other blocks when placed adjacent one another; and two or more pairs of corresponding tongue and grooves spaced along the top and bottom edges of the panels, the tongues and grooves extending transverse to the panel, the tongues protruding upwardly from the top edge of the panels, the grooves being recessed in the bottom edge of the panels, and the spacing of the pairs of corresponding tongue and grooves being such that the blocks cannot be stacked unless the tongue and grooves align which forces vertically adjacent blocks to interlock longitudinally so that the flanges of the ties of the vertically adjacent blocks align and form a substantially continuous vertical stud.

2. The concrete form block as recited in claim 1 wherein there are as many pairs of corresponding tongue and grooves as there are ties.

3. The concrete form block as recited in claim 2 wherein one pair of corresponding tongue and grooves is positioned correspondingly at each tie.

4. The concrete form block as recited in claim 3 wherein each pair of corresponding tongues and grooves comprises two closely spaced tongues, one tongue positioned at each of the two longitudinal peripheral edges of the flange of the corresponding tie, each tongue extending outwardly to the panel's outer face; and two closely spaced grooves, corresponding to the two closely spaced tongues and extending outwardly to the panel's outer face, wherein the tongues and grooves are visible at the outer face of the panel and delineate the location of the vertical stud.

5. The concrete form block as recited in claim 3 wherein the outer face of the panel is embossed for visually locating the location of the vertical stud.

6. The concrete form block as recited in claim 5 wherein the embossing comprises a first bas relief surface overlying the flange of a tie, the first surface representing the dimensional limits of the flange and further comprising a second narrower bas relief surface overlying the center of the flange, together the first and second surfaces demonstrating the location of the dimensional limits and the center of the flange.

7. The concrete form block as recited in claim 1 wherein the flanges of the ties are moulded within the panels.

8. The concrete form block as recited in claim 1 wherein the web portion comprises a plurality of horizontally extending members distributed substantially along the full height of the flanges, the web having a majority of its cross-sectional area comprising open space.

9. The concrete form block as recited in claim 8 wherein the web portion has at least four horizontally-oriented members distributed across the full height of the web, at least two of which are located above the web's midpoint and at least two of which are located below the web's mid-point.

10. In an insulating form system, a concrete form block which is stackable vertically at least one of above and below with others of the concrete form block, the system comprising first and second pairs of concrete foam panels having inner and outer faces, top edges, bottom edges and longitudinal end edges, the first pair of concrete foam panels being located below and adjacent to the second pair of concrete foam panels;

at least two ties spaced longitudinally from each other and extending between and engaging the first pair of concrete foam panels and at least two ties spaced longitudinally from each other and extending between and engaging the second pair of concrete foam panels so as to space the concrete foam panels in the first pair of concrete foam panels and the concrete foam panels in the second pair of concrete foam panels in opposing and parallel orientations; and connectors along a top edge of the first pair of concrete foam panels and along a bottom edge of the second pair of concrete foam panels, the connectors engaging an adjacent panel and thereby aligning the at least two ties between the first pair of concrete foam panels with the at least two ties between the second pair of concrete foam panels wherein the connector on a panel in the first pair of concrete foam panels engages a connector on a panel in the second pair of concrete foam panels to force the concrete foam panels into an orientation in which the at least two ties between the first pair of concrete foam panels are aligned with the at least two ties between the second pair of concrete foam panels.

11. The system of claim 10 wherein the connectors comprise:

two or more pairs of corresponding tongue and grooves spaced along the top and bottom edges of the concrete foam panels, the tongues and grooves extending transverse to the concrete foam panel, the tongues protruding upwardly from the top edge of the concrete foam panels, the grooves being recessed in the bottom edge of the concrete foam panels, and the spacing of the pairs of corresponding tongue and grooves being such that the concrete foam panels cannot be stacked unless the tongue and grooves align to force the concrete foam panels into an orientation in which the at least two ties between the first pair of concrete foam panels are aligned with the at least two ties between the second pair of concrete foam panels.

12. The system of claim 11 wherein there are as many pairs of corresponding tongue and grooves as there are ties.

13. The system of claim 12 wherein one pair of corresponding tongue and grooves is positioned correspondingly at each tie.

14. The system of claim 13 wherein the tie has laterally-spaced and longitudinally extending peripheral edges for defining lateral dimensional width of the tie and a tie center and wherein each pair of corresponding tongues and grooves comprises:

two closely spaced tongues, one tongue positioned at each of the two peripheral edges of the corresponding tie, each tongue extending outwardly to the concrete foam panel's outer face; and two closely spaced grooves, corresponding to the two closely spaced tongues and extending outwardly to the concrete foam panel's outer face, wherein the tongues and grooves are visible at the outer face of the concrete foam panel and delineate the location of the tie.

15. The system of claim 13 wherein the outer face of the concrete foam panel is embossed for visually locating the location of the ties.

16. The system of claim 15 wherein the embossing comprises a first bas relief surface overlying the tie, the first surface representing the dimensional width of the tie and further comprising a second narrower bas relief surface overlying the center of the tie, together the first and second surfaces demonstrating the location of the dimensional width and the center of the tie.

17. A method for stacking pairs of concrete forms, comprising:

engaging at least two ties with a first pair of concrete foam panels having inner and outer faces, top edges, bottom edges, and longitudinal end edges, such that the inner faces of the first pair of concrete foam panels are in an opposing and spaced apart relationship;

engaging at least two ties with a second pair of concrete foam panels having inner and outer faces, top edges, bottom edges, and longitudinal end edges, such that the inner faces of the second pair of concrete foam panels are in an opposing and spaced apart relationship;

stacking the second pair of concrete foam panels above the first pair of concrete foam panels; and engaging a connector on one of the concrete foam panels in the first pair of concrete foam panels with a connector on an adjacent panel in the second pair of concrete foam panels to cause vertical alignment of the at least two ties between the second pair of concrete foam panels and the at least two ties between the first pair of concrete foam panels.

18. The method of claim 17, wherein the connectors force the concrete foam panels into an orientation in which the ties between the first pair of concrete foam panels are aligned with the ties between the second pair of concrete foam panels.

19. The method of claim 17, wherein one of the connectors is a tongue and the other of the connectors is a groove that engages the tongue.

* * * * *